US011998089B2

(12) United States Patent
Kemmer

(10) Patent No.: US 11,998,089 B2
(45) Date of Patent: Jun. 4, 2024

(54) CLASP AND METHOD OF RETAINING GARMENT

(71) Applicant: DESIDARA, Uniontown, OH (US)

(72) Inventor: Robert M. Kemmer, Lincoln, NH (US)

(73) Assignee: DESIDARA, Uniontown, OH (US)

( * ) Notice: Subject to any disclaimer, the term of this patent is extended or adjusted under 35 U.S.C. 154(b) by 239 days.

(21) Appl. No.: 17/550,609

(22) Filed: Dec. 14, 2021

(65) Prior Publication Data

US 2022/0183413 A1 Jun. 16, 2022

Related U.S. Application Data

(60) Provisional application No. 63/126,279, filed on Dec. 16, 2020.

(51) Int. Cl.
*A44B 6/00* (2006.01)

(52) U.S. Cl.
CPC ..... *A44B 6/00* (2013.01)

(58) Field of Classification Search
CPC ... A44B 6/00; A41F 1/00; E06C 7/186; A62B 35/005; A62B 35/0081; Y10T 24/2584
See application file for complete search history.

(56) References Cited

U.S. PATENT DOCUMENTS

| | | | | |
|---|---|---|---|---|
| 2,981,990 | A | 5/1961 | Balderree, Jr. | |
| 3,765,062 | A | 10/1973 | Cruse | |
| 4,413,383 | A | 11/1983 | Spalding | |
| 4,932,104 | A | 6/1990 | Kowal | |
| 9,247,777 | B2 * | 2/2016 | Sullivan | A41F 19/00 |
| 10,178,906 | B2 | 1/2019 | Eggleston et al. | |
| 2005/0278830 | A1 * | 12/2005 | Hokin | A42B 1/041 2/207 |
| 2010/0043125 | A1 * | 2/2010 | MacLean | A44B 11/04 2/336 |
| 2011/0209710 | A1 * | 9/2011 | Spencer, III | A41D 13/1107 128/206.12 |
| 2014/0304898 | A1 * | 10/2014 | Bachtold | A44B 11/04 2/336 |
| 2015/0013049 | A1 | 1/2015 | Sullivan et al. | |

FOREIGN PATENT DOCUMENTS

| | | | |
|---|---|---|---|
| EP | 0005855 | A2 | 12/1979 |
| WO | 2016106054 | A1 | 6/2016 |

OTHER PUBLICATIONS

International Search Report and Written Opinion of the International Searching Authority for International Application No. PCT/US2021/063312 dated Apr. 18, 2022, 12 pages.

* cited by examiner

*Primary Examiner* — Robert Sandy
(74) *Attorney, Agent, or Firm* — Finch & Maloney PLLC

(57) ABSTRACT

A clasp for a garment such as a bandana is described. The clasp consists of two distinct portions, each of which can be different or identical. Each portion includes three or more passages that allow the ends of a bandana or other garment to be threaded through each. The complementary portions are then connected to each other.

20 Claims, 3 Drawing Sheets

CLASP AND METHOD OF RETAINING GARMENT

TECHNICAL FIELD

This disclosure relates to a device for retaining a garment on a wearer, and, in particular, to a device and method for safely retaining a face covering on a wearer.

BACKGROUND

To prevent the transmission of pathogens, people will often wear a face mask to reduce the expulsion or intrusion of aerosols. One type of face mask that has become popular is a bandana formed by folding a rectangular piece of cloth into a triangle that can then be tied behind the wearer's neck.

SUMMARY OF THE INVENTION

In one aspect a garment clasp is provided, the garment clasp including a first substantially planar body having a proximal end portion, a distal end portion and a central portion, the distal and proximal end portions each having a width greater than a width of the central portion, the elongated body defining three or more passages therethrough, a first passage at the proximal end portion, a second passage at the distal end portion and a central passage positioned between the first and second passage, and a second substantially planar body having a proximal end portion, a distal end portion and a central portion, the distal and proximal end portions each having a width greater than a width of the central portion, the second elongated body defining three or more passages therethrough, a first passage at the proximal end portion, a second passage at the distal end portion and a central passage positioned between the first and second passage, wherein the width of the proximal portion of the first body is greater than a width of the first passage in the second body and the proximal portion of the first body can be deformed by the wearer to pass through the first passage in the second body, removably securing the first body to the second body.

The first substantially planar body and the second substantially planar body can be identical. The width of the central portion of the first body can be equal to or less than the width of the first passage in the second body. The planar bodies may be comprised of a polymer selected from one of EVA, silicone, PVC, polyamide and polyurethane and may include a score line, indent or perforation. The garment clasp is designed to fail when a tensile force of greater than 5, greater than 10, greater than 20 N, greater than 50 N, or greater than 100 N is applied. The first passage in the second body can be deformed to allow the proximal portion of the first body to pass through the first passage. At least the first substantially planar body can be symmetrical. A garment can include any of these embodiments and additionally a bandana including two opposed corners wherein a first corner is threaded through two of the passages of the first planar body and a second corner is threaded through two of the passages of the second planar body.

In another aspect, a method is provided, the method comprising folding a rectangular piece of cloth to produce a substantially right triangle having a 90 degree point, a first 45 degree point and a second 45 degree point, threading the first 45 degree point through a first passage in a first planar connector and subsequently through a second passage in the first planar connector, threading the second 45 degree point through a first passage in a second planar connector and subsequently through a second passage in the second planar connector, and connecting the first planar connector to the second planar connector by deforming one end of the first planar connector and passing it through a third passage in the second planar connector. The method can include releasing the bandana by applying adequate tension to de-thread at least one of the 45 degree points from the first or second planar connector. Releasing the bandana can be done by applying adequate tension to separate the first planar connector from the second planar connector. Enough tension may be applied to break at least one of the first planar connector and the second planar connector. The method may include deforming the third passage in the second planar connector to facilitate passage of the one end of the first planar connector. The wearer can thread the 45 degree points prior to placing the cloth around their head and then connects the first and second planar connectors after placing the cloth around their head. The tensile force applied can be applied quickly enough that the 45 degree points cannot unthread and the planar connectors do not separate.

The systems, devices and methods described herein may be used separately or together, and components or techniques described in relation to one system or method are capable of being implemented with the others. The subject matter of this application may involve, in some cases, interrelated products, alternative solutions to a particular problem, and/or a plurality of different uses of a single system or article.

The above-mentioned and other features of this disclosure, and the manner of attaining them, will become more apparent and better understood by reference to the following description of embodiments described herein taken in conjunction with the accompanying drawings, wherein:

DETAILED DESCRIPTION

Bandanas have become a popular form of face mask and are in wide use throughout the world. To form a bandana, a wearer typically folds a rectangular (often square) piece of cloth into a triangle by joining two opposing corners together. The corners that were not folded towards each other form points of approximately 45 degrees each. The user ties these points together behind their neck to secure the bandana in place. Once tied, the bandana is not adjustable and is so securely tied behind the neck of the wearer that it does not release if it is tugged on or catches on a piece of machinery or moving object. This lack of release can result in injury to the user.

In one aspect, this disclosure describes a clasp that provides for easy adjustment of the bandana as well as for a safe release under sudden or severe tension. The clasp includes two distinct bodies, that may be identical. The two bodies can be comprised of a resilient material that can be deformed by hand. One end of the bandana is threaded through orifices, or passages, in one of the bodies and the opposing end of the bandana is threaded through passages in the other body. The bodies are then connected together by deforming one end of the first body and pushing it through a passage in the second body. Once the deformed end is released, the first body is securely but removably attached to the second, keeping the bandana (or other garment) in place. The tightness of the bandana can be adjusted by further threading the fabric through the passages or by de-threading (backing off) the fabric through these passages. When tension is applied to the garment, the fabric can slip through the passages allowing for the release of the garment from the wearer. In other cases, tension results in deformation of the one or more of the two bodies, allowing the end of the first body to slip through the passage of the second. In instances of extreme tension, either or both of the bodies can tear, releasing the ends of the garment immediately.

Figure 1:
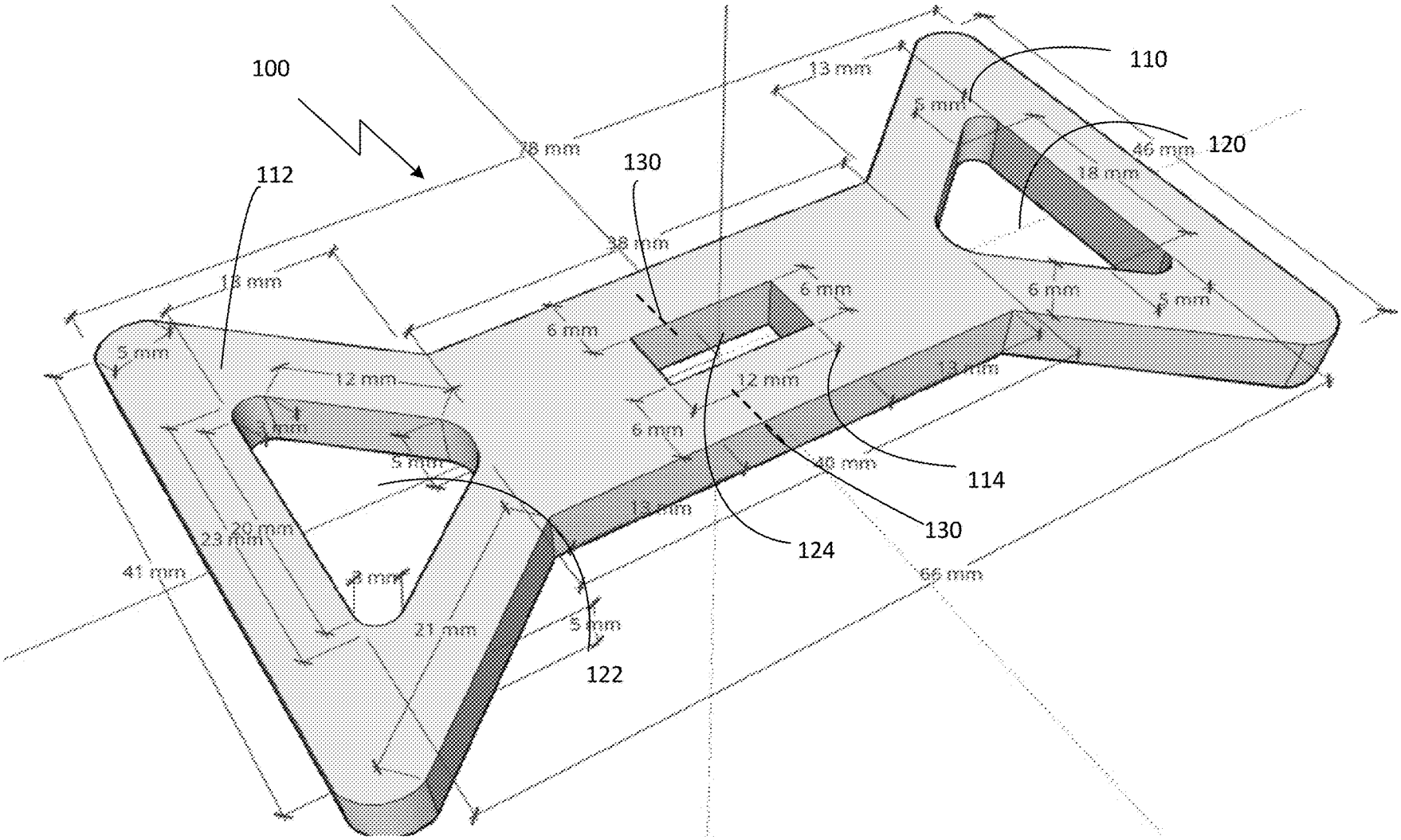
FIG. 1 illustrates one embodiment of a portion of a clasp.

FIG. 1 provides one embodiment of a body that can form half of a clasp. As shown, body 100 is substantially planar, meaning that it is flat on both the upper and lower sides, without any protruding tabs or hooks. The body can be comprised of flexible material that is flexible enough that it can be bent by hand (between thumb and forefinger) so that at least a portion of the material can be deflected 10 degrees. In some embodiments, the planar material can be deflected, between thumb and forefinger, greater than 45 degrees, greater than 90 degrees or up to 180 degrees, so that opposite ends of the planar body can contact each other. As used herein, the term "deformable" means that the body can change shape by squeezing between a thumb and forefinger. A resilient material is one that can be deformed and will return to its original shape upon release.

In various embodiments, the body can be made from a polymer, paper, cardboard or fabric. Suitable polymers include silicone, EVA, PVC, thermoplastics, PVDF, polyamide and polyurethane. In some embodiments, the polymer can be a non-allergenic polymer such as, for example, EVA or silicone. The body can be made by methods know to those of skill in the art such as by die cutting, extrusion, molding and 3-D printing. The material may be of consistent thickness (less than 5% variation) or can be of variable thickness in different portions. Thicknesses may be, for example, less than 5 mm, less than 3 mm, less than 2 mm or less than 1 mm. In other embodiments, the thickness of the body maybe greater than 0.25 mm, greater than 0.5 mm, greater than 1 mm, greater than two mm or greater than 3 mm. In specific embodiments the thickness range maybe from 0.5 to 5 mm, from 0.5 to 3 mm, from 0.5 to 2 mm, from 1 to 10 mm.

As illustrated in FIG. 1, an individual planar body may be elongated and may have wider portions at opposed ends than in the middle of the body. For example, body 100 includes proximal end 110 and distal end 112 that have approximately equal widths and are greater than (about twice) the width of central portion 114. As shown, the elongated body is symmetrical and includes three passages; 120, 122 and 124. As shown, the passages pass entirely through the body and are the only indentations on either side of the elongated body 100. Proximal passage 120 and distal passage 122, as shown, are of equal shape and dimensions although in other embodiments the shape and dimensions of these passages may vary. Central passage 124 is shown as rectangular and can typically be a smaller passage than either the proximal passage 120 or the distal passage 122. In the embodiment shown, the proximal and distal passages are approximately triangular in shape with rounded corners having curvatures of three or 5 mm. In other embodiments, the radius of curvature of these corners can vary from 0.5 millimeters up to 1 centimeter or greater. Central passage 124 shows squared corners but may also be rounded as are the corners of the other passages. Passage 124 is rectangular in shape but can be other shapes, such as, triangular, square, round or polygonal. The upper and lower edges of the passages may also be rounded and can have a radius of curvature of, for example, 1 millimeter, 2 millimeters, 3 millimeters or greater.

Also shown in FIG. 1 is score line 130 which can be, for example, a perforation or indent. The score line provides a point of weakness where the elongated body is designed to break under specific tensile forces. For example, the elongated material may fail at line 30 when subjected to a tensile force of greater than 1 N, greater than 5 N, greater than 10 N, greater than 20 N, greater than 50 N or greater than 100 N. In the same and other embodiments, the elongated body can withstand, without parting, a tensile force of greater than 1 N, greater than 2 N, greater than 5 N, greater than 10 N, or greater than 20 N.

Although the embodiment shown illustrates three passages, other embodiments may include 2, 3, 4, 5 or more passages. Additional passages may allow for adjustment of the clasp without removing the garment from the individual elongated bodies.

Figure 2:
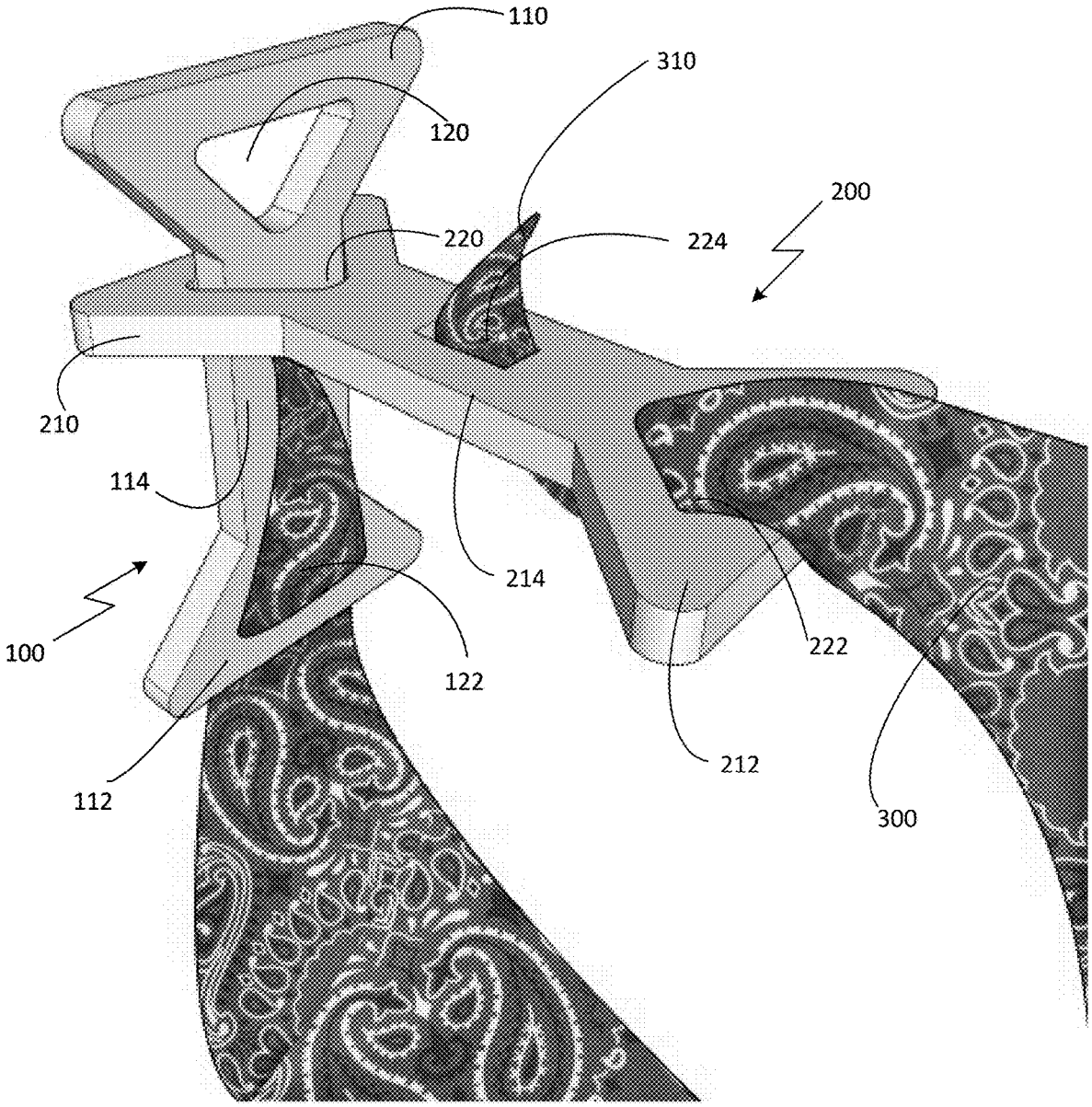
FIG. 2 illustrates one embodiment of threading a bandana through a clasp.

FIG. 2 provides an illustration showing the installation of a bandana 300 in one embodiment of the bandana clasp. Shown are first elongated body 100 and second elongated body 200. As can be seen, the bandana has been folded into a triangle and the two acute ends of the bandana have been threaded through their respective elongated bodies. For example, looking at elongated body 200, the bandana was first threaded through passage 222, passed underneath a central portion of the body, and was pulled up vertically through central passage 224. Similarly, the opposed end of the bandana was threaded through passage 122 up past the central portion of elongated body 100 and back through central passage 124 (not shown). After each end of the bandana has been threaded, the two elongated bodies can be attached together by pushing resilient end 110 through resilient passage 220 until the larger portion of end portion 110 has passed through passage 220 and can re-expand. Resilient passage 220 may expand as end portion 110 is forced through it and will retract to its original size and shape after passage of end portion 110. At this point, the ends of the bandana are secured together via the interaction of the two elongated bodies. Note that in some embodiments, the interaction between the two elongated bodies can be by deforming the end of the elongated body or by changing the angle of the elongated body so that it fits through passage 220 and locks into place once it is realigned after passing through. After elongated body 100 is interlocked with elongated body 200, the tightness of the bandana can be adjusted by further threading bandana end 310 continually through passage 224 or by de-threading the bandana backwards through the same passage.

Figure 3:
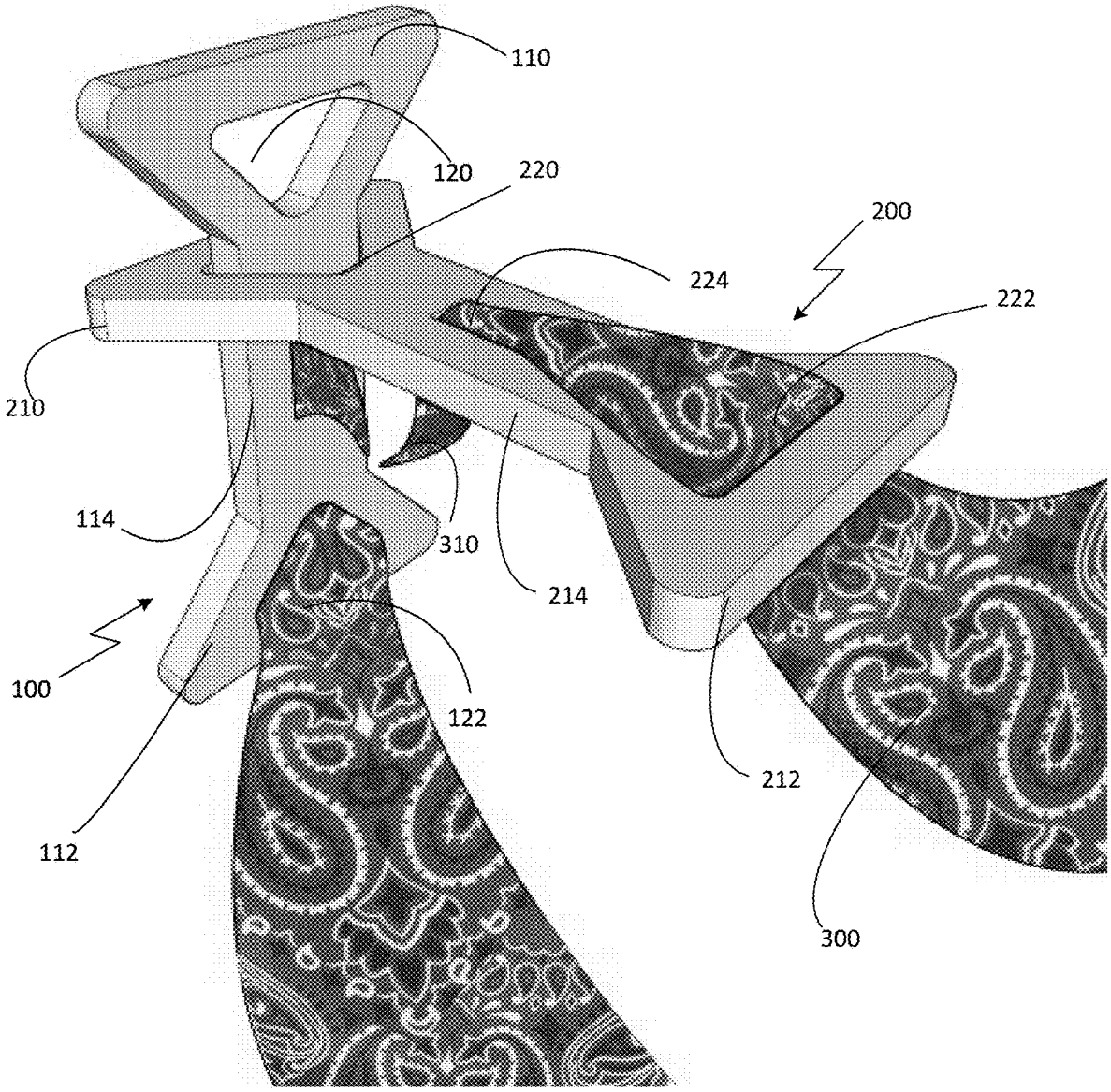
FIG. 3 illustrates a second embodiment of threading a bandana through a clasp.

The embodiment shown in FIG. 3 shows the same clasp as in FIG. 2 but the bandana 300 is threaded in a different direction. As shown, leading corner 310 of bandana 300 has initially been passed underneath the surface of elongated body 200 up through passage 222 across central portion 214 and then down through passage 224. The threading pattern is essentially opposite of that shown in FIG. 2 and the threading through elongated body 100 can be either identical to or the opposite of the threading through elongated body 200.

When the wearer desires to remove the bandana, the clasps can be disconnected by passing end portion 110 back through orifice 220 to release the two elongated bodies, or the ends of the bandana can be pulled backwards through passage 224 and 222 or through 124 and 122. When tension is applied to the bandana the tension is transferred to the clasp and may release in one or more of three different ways. In the first manner, such as when a slow steady force is applied, the end of bandana 310 is simply pulled slowly back through the passages in the clasp leaving the two elongated bodies attached together, absent at least one end of the bandana. In a second scenario, enough tension is applied that one or both of end portion 110 and passage 220 are able to deform to an extent where elongated body 100 is pulled through orifice 220 and therefore released from the other elongated body of the clasp. In a third scenario, an intense force is provided, and a sudden extreme tensile force is placed on the system. In this case one or both elongated bodies may fail by separating at a point of weakness such as score line 130. Other points of weakness may include an area of less thickness such as one that may have been heat stamped, or may simply be the narrowest (point of least material in cross section) section of the elongated body. In any case, the wearer can be assured that the bandana will be released from his or her neck should a force from a person, vehicle or machine pull on the bandana in a dangerous manner.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

All references, patents and patent applications and publications that are cited or referred to in this application are incorporated in their entirety herein by reference.

What is claimed is:

1. A garment clasp comprising:

a first substantially planar body having a proximal end portion, a distal end portion and a central portion, the distal and proximal end portions each having a width greater than a width of the central portion, the substantially planar body defining three or more passages therethrough, a first passage at the proximal end portion, a second passage at the distal end portion and a central passage positioned between the first and second passage; and a second substantially planar body having a proximal end portion, a distal end portion and a central portion, the distal and proximal end portions each having a width greater than a width of the central portion, the second substantially planar body defining three or more passages therethrough, a first passage at the proximal end portion, a second passage at the distal end portion and a central passage positioned between the first and second passage, the width of the central portion of the first body being equal to or less than the width of the first passage in the second body, and wherein the width of the proximal portion of the first body is greater than a width of the first passage in the second body and the proximal portion of the first body can be deformed by the wearer to pass through the first passage in the second body, removably securing the first body to the second body.

2. The garment clasp of claim 1 wherein the first substantially planar body and the second substantially planar body are identical.

3. The garment clasp of claim 1 wherein the planar bodies are comprised of a polymer selected from one of EVA, silicone, PVC, polyamide and polyurethane.

4. The garment clasp of claim 1 wherein at least one of the first and second planar bodies includes a score line, indent or perforation.

5. The garment clasp of claim 1 wherein at least one of the first and second planar bodies fails when a tensile force of greater than 50 N is applied to the clasp.

6. The garment clasp of claim 1 wherein at least the first substantially planar body is symmetrical.

7. A garment comprising:

the garment clasp of claim 1; and a bandana including two opposed corners wherein a first corner is threaded through two of the passages of the first planar body and a second corner is threaded through two of the passages of the second planar body.

8. A garment clasp comprising:

a first substantially planar body having a proximal end portion, a distal end portion and a central portion, the distal and proximal end portions each having a width greater than a width of the central portion, the substantially planar body defining three or more passages therethrough, a first passage at the proximal end portion, a second passage at the distal end portion and a central passage positioned between the first and second passage; and a second substantially planar body having a proximal end portion, a distal end portion and a central portion, the distal and proximal end portions each having a width greater than a width of the central portion, the second substantially planar body defining three or more passages therethrough, a first passage at the proximal end portion, a second passage at the distal end portion and a central passage positioned between the first and second passage wherein the width of the proximal portion of the first body is greater than a width of the first passage in the second body and the proximal portion of the first body can be deformed by the wearer to pass through the first passage in the second body, removably securing the first body to the second body, and wherein the first passage in the second body is deformed to allow the proximal portion of the first body to pass through the first passage in the second body.

9. The garment clasp of claim 8 wherein at least one of the first and second planar bodies includes a score line, indent or perforation.

10. The garment clasp of claim 8 wherein the planar bodies are comprised of a polymer selected from one of EVA, silicone, PVC, polyamide and polyurethane.

11. The garment clasp of claim 8 wherein at least one of the first and second planar bodies fails when a tensile force of greater than 50 N is applied to the clasp.

12. The garment clasp of claim 8 wherein at least the first substantially planar body is symmetrical.

13. A garment comprising:

the garment clasp of claim 8; and a bandana including two opposed corners wherein a first corner is threaded through two of the passages of the first planar body and a second corner is threaded through two of the passages of the second planar body.

14. A method of securing a garment to a wearer, the method comprising:

folding a rectangular piece of cloth to produce a substantially right triangle having a 90 degree point, a first 45 degree point and a second 45 degree point;

threading the first 45 degree point through a first passage in a first planar connector and subsequently through a second passage in the first planar connector;

threading the second 45 degree point through a first passage in a second planar connector and subsequently through a second passage in the second planar connector; and connecting the first planar connector to the second planar connector by deforming one end of the first planar connector and passing it through a third passage in the second planar connector.

15. The method of claim 14 further comprising releasing the rectangular piece of cloth by applying adequate tension to de-thread at least one of the 45 degree points from the first or second planar connector.

16. The method of claim 14 further comprising releasing the rectangular piece of cloth by subjecting the garment to adequate tension to separate the first planar connector from the second planar connector.

17. The method of claim 14 further comprising releasing the rectangular piece of cloth by subjecting the garment to adequate tension to break at least one of the first planar connector and the second planar connector.

18. The method of claim 17 wherein the garment is subjected to the tension quickly enough that the 45 degree points cannot unthread and the planar connectors do not separate.

19. The method of claim 14 comprising deforming the third passage in the second planar connector to facilitate passage of the one end of the first planar connector.

20. The method of claim 14 wherein the wearer threads the 45 degree points prior to placing the cloth around their head and connects the first and second planar connectors after placing the cloth around their head.

* * * * *